US006874256B2

(12) United States Patent
Delgatty

(10) Patent No.: US 6,874,256 B2
(45) Date of Patent: Apr. 5, 2005

(54) SHOE WITH REMOVABLE VAMP

(75) Inventor: Grant Verdun Delgatty, Studio City, CA (US)

(73) Assignee: Vans, Inc., Santa Fe Springs, CA (US)

( * ) Notice: Subject to any disclaimer, the term of this patent is extended or adjusted under 35 U.S.C. 154(b) by 0 days.

(21) Appl. No.: 10/407,026

(22) Filed: Apr. 4, 2003

(65) Prior Publication Data

US 2004/0194349 A1 Oct. 7, 2004

(51) Int. Cl.[7] ..... A43B 3/24
(52) U.S. Cl. ..... 36/100; 36/101
(58) Field of Search ..... 36/101, 100

(56) References Cited

U.S. PATENT DOCUMENTS

| | | | | |
|---|---|---|---|---|
| 2,552,638 A | | 5/1951 | Meltzer | 12/142 |
| 3,922,435 A | | 11/1975 | Asnes | 428/349 |
| 3,972,136 A | | 8/1976 | Epstein | 36/101 |
| 4,103,440 A | | 8/1978 | Lawrence | 36/101 |
| 4,333,248 A | | 6/1982 | Samuels | 36/72 |
| 4,557,964 A | | 12/1985 | Magnotta | 428/187 |
| 4,581,266 A | | 4/1986 | Magnotta | 428/40 |
| 4,704,810 A | | 11/1987 | Massengale | 36/130 |
| 4,733,439 A | | 3/1988 | Gentry | 24/143 |
| 4,745,693 A | | 5/1988 | Brown | 36/101 |
| 4,852,276 A | | 8/1989 | Savoca | 36/136 |
| 4,974,344 A | | 12/1990 | Ching | 36/101 |
| 5,074,060 A | | 12/1991 | Brncick et al. | 36/77 |
| 5,359,790 A | | 11/1994 | Iverson et al. | 36/136 |
| 5,367,795 A | | 11/1994 | Iverson et al. | 36/136 |
| 5,544,430 A | | 8/1996 | Jacko | 36/7.1 R |
| 5,778,564 A | | 7/1998 | Kettner | 36/101 |
| 5,822,888 A | | 10/1998 | Terry | 36/100 |
| 5,842,096 A | | 11/1998 | Mabbott | 399/302 |
| 5,983,528 A | | 11/1999 | Hartung | 36/15 |
| 6,198,898 B1 | | 3/2001 | Mabbott | 399/302 |
| 6,212,797 B1 | | 4/2001 | Merry et al. | 36/101 |
| 2002/0114925 A1 | * | 8/2002 | Balz et al. | 428/151 |

FOREIGN PATENT DOCUMENTS

| | | |
|---|---|---|
| GB | 2273466 | 6/1994 |
| WO | WO 95/25987 | 9/1995 |
| WO | WO 98/39166 | 9/1998 |
| WO | WO 01/87643 | 11/2001 |

* cited by examiner

*Primary Examiner*—Ted Kavanaugh
(74) *Attorney, Agent, or Firm*—Winston & Strawn LLP

(57) ABSTRACT

A shoe construction including a removable vamp. In an implementation, the shoe includes an outsole, an upper attached to the outsole, the upper including an elastic material that spans a throat area, a removable vamp, a throat fastening means, and a vamp fastening means. The throat fastening means and the vamp fastening means provide a two-point connection that stabilizes the removable vamp so that it remains in the correct position during wear of the shoe. A customizing kit may be provided to permit a consumer to customize the vamp, for example, by applying a heat transfer image to the vamp.

10 Claims, 4 Drawing Sheets

SHOE WITH REMOVABLE VAMP

BACKGROUND

This invention generally relates to footwear, and more particularly to a shoe including a removable vamp that can be customized.

In conventional constructions of slip-on shoes, the vamp, which is that portion of the upper that encases the toe and instep region of a wearer's foot, is generally formed in two parts. The first part is a mudguard extending upward from the periphery of the sole in the forward region of the shoe, and the second part is an insert secured to the upper periphery of the mudguard and bridging the mudguard so as to enclose the instep and toe regions of the wearer's foot.

Shoes with removable uppers are known. However, some were found to be expensive to manufacture, others were uncomfortable, and yet others were not customizable.

SUMMARY OF THE INVENTION

The invention pertains to a shoe construction that includes a removable vamp and is comfortable. In an implementation, the shoe includes an outsole, an upper attached to the outsole, the upper including an elastic material that spans a throat area, a removable vamp, a throat fastening means including a first portion associated with the elastic material and a second portion associated with the vamp, and a vamp fastening means. The throat fastening means and the vamp fastening means provide a two-point connection that stabilizes the removable vamp so that it remains in the correct position during wear of the shoe.

The invention may include one or more of the following features. The vamp fastening means may include a first slide track associated with the upper and outsole, the first slide track extending around the perimeter of a toe area, a second slide track associated with the vamp that matches the first slide track, and a pull tab. The first slide track may be connected to at least one of the outsole and the upper. The first slide track, the second slide track and the slide fastener may be a zipper fastener. A material flap may be included that hides the vamp fastening means when the vamp is attached. The throat fastening means may be a hook and loop type fastener. The removable vamp may be formed of a material that can be smoothed flat when detached from the shoe. A customizing kit may be included with the shoe, and the customizing kit may include at least one of extra removable vamps, heat transfer paper, paints and a brush.

Another aspect of the invention pertains to a method for customizing a portion of a shoe is disclosed. In an implementation, the technique involves flattening a removable vamp on a surface, aligning a sheet of heat transfer paper containing a design over the vamp, applying heat to a heat transfer paper so as to transfer the design to the vamp, and attaching the vamp to the shoe. The method may also include applying paint to the vamp to create a design.

A shoe according to the invention includes features that permit the shoe to be secured to the foot of a wearer in a comfortable and firm manner. In addition, the overall construction of the shoe and vamp permits a two-point connection to be made that stabilizes the vamp during normal use. In particular, a first point of contact for the vamp is the elastic material that spans the throat area of the shoe, and the second point of contact is via the slide fastener to the upper peripheral edge of the outsole about the toe and instep areas. Further, the removable vamp is capable of being smoothed out or flattened so that a heat transfer image or other design can be easily applied to it so as to customize the shoe.

The details of one or more embodiments of the invention are set forth in the accompanying drawings and the description below. Other features and advantages of the invention will be apparent from the description and drawings, and from the claims.

BRIEF DESCRIPTION OF THE DRAWINGS

Like reference symbols in the various drawings indicate like elements.

DETAILED DESCRIPTION

Figure 1:
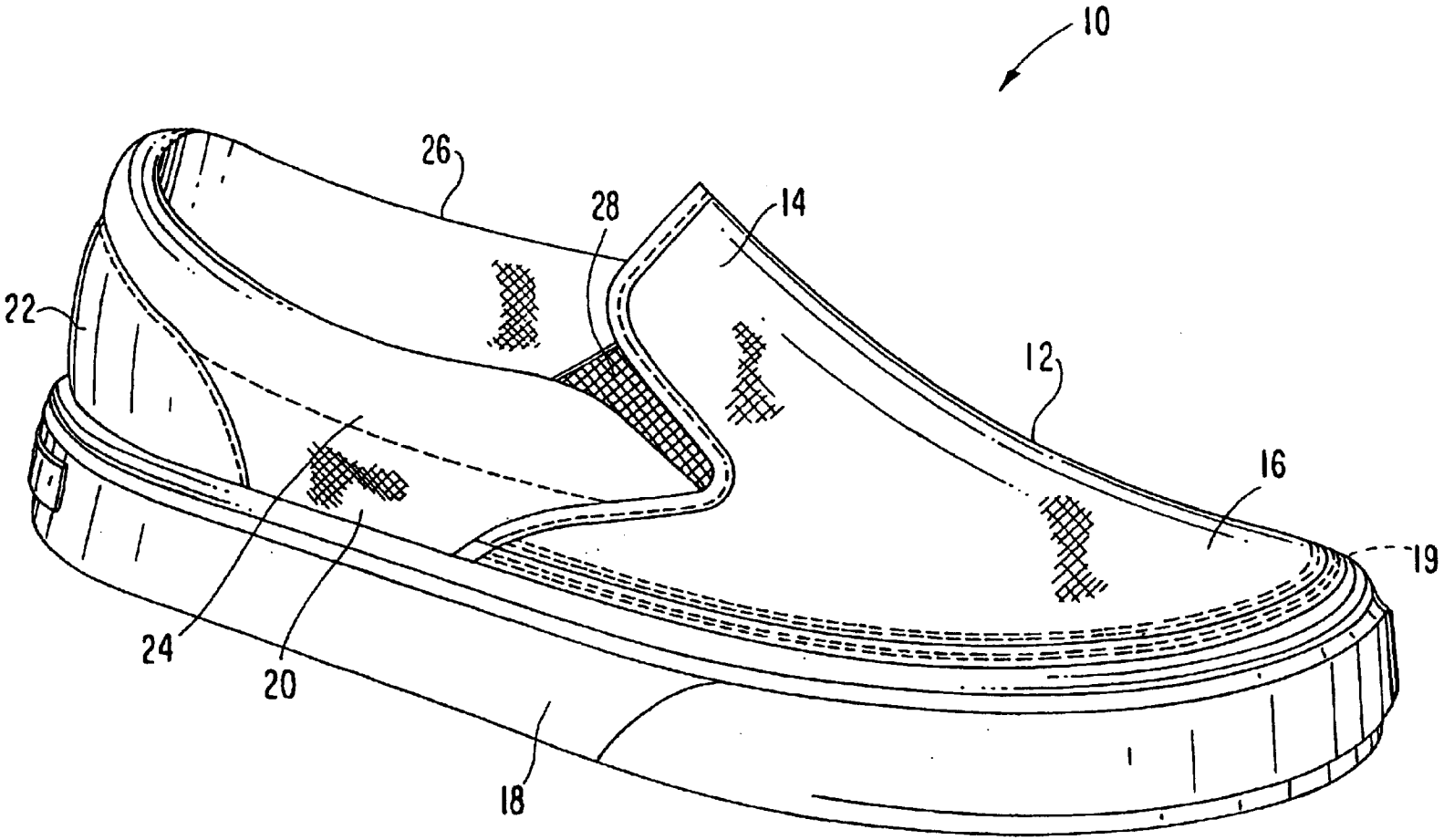
FIG. 1 is a side elevation view of a slip-on type shoe construction that includes a removable vamp according to the invention.

FIG. 1 is a side elevation view of a slip-on type shoe construction 10 that includes a removable vamp 12. The vamp 12 includes a tongue portion 14 and a toe portion 16. An outsole 18 is connected to an upper portion 20 in a conventional manner. In this implementation, the upper includes a rear quarter 22, a lateral side portion 24 and a medial portion 26. An elastic material piece 28 is positioned in the throat area, and is connected to the upper lateral side 24 and to the upper medial side 26 of the shoe upper to span the throat area of the shoe. The lower periphery of the vamp 12 is removably connected to the outsole via a slide fastener means (shown in FIG. 2) that is hidden behind a material flap 19 in this example. The vamp may be constructed of a canvas or other flexible material, such as leather or a composite material, that can be smoothed flat on a flat surface when detached and separated from the outsole 18 and/or upper 20 (as shown in FIG. 2).

Figure 2:
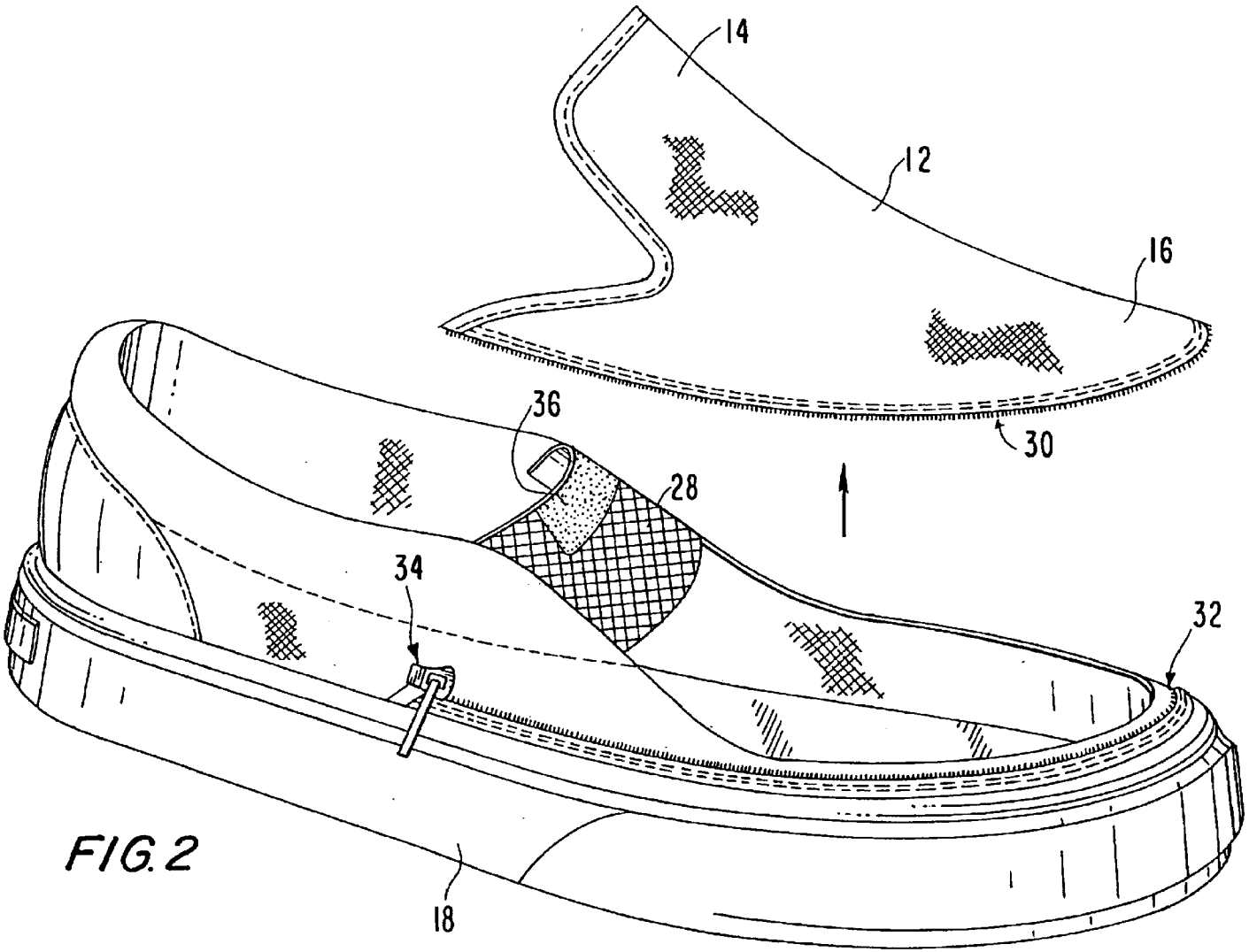
FIG. 2 is an exploded view of the shoe construction 10 of FIG. 1

FIG. 2 is an exploded view of the shoe construction 10 of FIG. 1. In this implementation, a vamp fastening means includes a conventional zipper fastening device having parallel rows of metal, plastic or nylon teeth 30 and 32 on adjacent edges that are interlocked by a sliding tab 34. The first row of teeth 30 is connected to the lower peripheral edge of the removable vamp 12, and the second row of teeth 32 is connected to the upper peripheral edge of the outsole 18. The sliding tab 34 travels along the teeth 32 in a path that extends from the approximate middle of the lateral side of the shoe, around the edge of the toe area, and ends at the approximate middle of the medial side of the shoe (not shown). It should be understood that the length of the zipper teeth could be longer or shorter, that suitable slide fastener means may include conventional metallic, plastic or composite material zippers, and that smooth track slide closure devices, such as that found on plastic food storage bags, could be used. Other types of slide fastening devices could also be used. Multiple slide fasteners or other types of removable fasteners or combinations thereof could also be utilized, but such configurations may not be as convenient to fasten and unfasten as the implementation shown in the figures. When the vamp is fully attached to the upper, all of the components of the zipper fastener including the zipper teeth 30, teeth 32, and pull tab 34, may be hidden behind a flap of material as shown in FIG. 1, or may be fully or partially exposed depending on the design of the shoe.

The shoe construction 10 also includes a throat fastening means that connects the throat area 14 of the vamp to the elastic material 28. In an implementation, the throat fastening means includes a first fastening means portion 36 connected to the elastic material 28, and a second fastening means portion 38 connected beneath the throat area 14 of the vamp 12 (as shown in FIG. 4). Thus, when the vamp 12 is connected to the shoe as shown in FIG. 1, the first fastening means portion 36 releasably mates with the second fastening means portion 38 (see FIGS. 2, 3 and 4).

Figure 3:
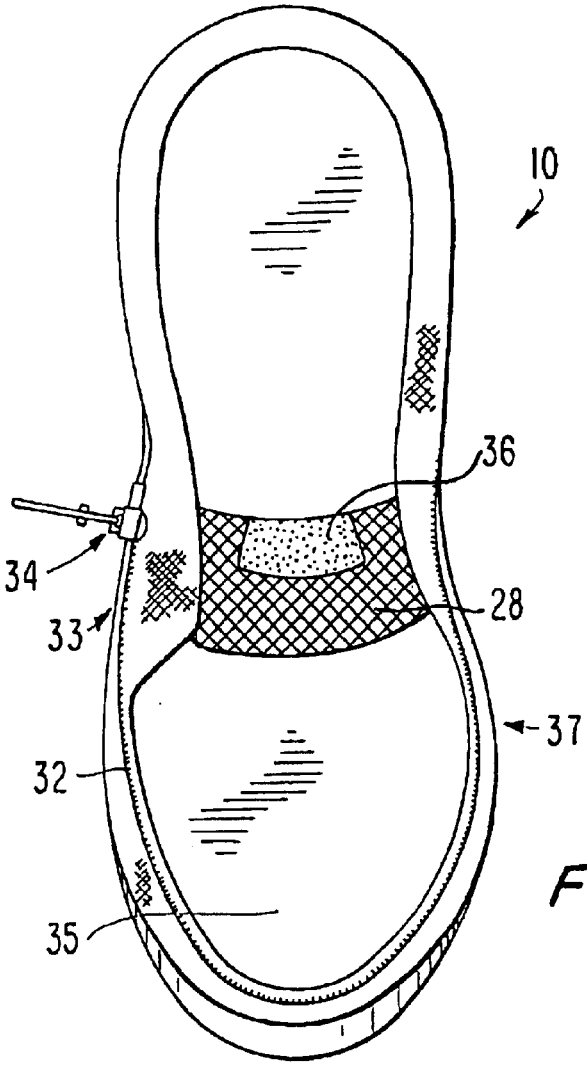
FIG. 3 is a top view of the shoe construction of FIG. 1 with the vamp removed.
Figure 4:
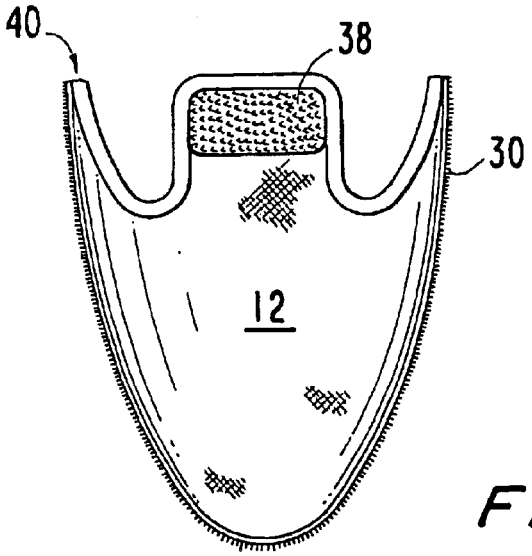
FIG. 4 is a bottom view of the removable vamp of FIGS. 1 and 2.

FIG. 3 is a top view of the shoe of FIG. 1 with the vamp removed. As explained above, the sliding pull tab 34 travels along a generally U-shaped path defined by the teeth 32 that begins on the lateral side 33, continues around the toe area 35, and extends to the medial side 37 of the shoe. As described above, the elastic material 28 includes a first fastening means portion 36 that is removeably attachable to a second fastening means portion 38 on the vamp 12 (see FIG. 4). The first and second fastening portions 36, 38 may be a hook and loop-type fastener or another type of releasable fastener that may be used to conveniently remove and reattach the throat portion 14 of the vamp 12 to the elastic material 28. Thus, in the embodiment shown in FIG. 1 the vamp 12 is releasably connected via the zipper fastener along its peripheral edge to the outsole 18, and connected via the hook and loop fastening means 36, 38 to the elastic material 28 in its throat area 14. The shoe construction 10 is comfortable because the elastic material 28 functions to comfortably hold the foot inside the shoe even if the vamp 12 has been removed. Moreover, when the vamp 12 is fully connected, the throat fastening means and the vamp fastening means provide a two-point connection that stabilizes the removable vamp 12 so that it remains in the correct position during normal wear of the shoe.

FIG. 4 is a bottom view 40 of the removable vamp 12 of FIGS. 1 and 2. Teeth 30 are configured to mate with teeth 32 when aligned therewith and the slide pull 34 is pulled along the path defined by the teeth. The second portion 38 of the throat fastening means for attachment to the first portion 36 of the throat fastening means is shown. The slide fastener means and the throat fastening means combine to provide a stable contact between the vamp and the rest of the shoe, which results in a good fit and a nice appearance.

In the implementation of FIGS. 1 to 4, the upper 20 is shown connected to the outsole 18 about the entire upper periphery of the outsole in a known manner. However, the upper could be connected to the outsole in the heel and rearward lateral and medial portions only, or otherwise attached to the outsole. In addition, the slide fastener teeth 32 could be attached directly to the upper peripheral portion of the outsole, or could be stitched or otherwise attached to a piece of material that is attached to the outsole.

Figure 5:
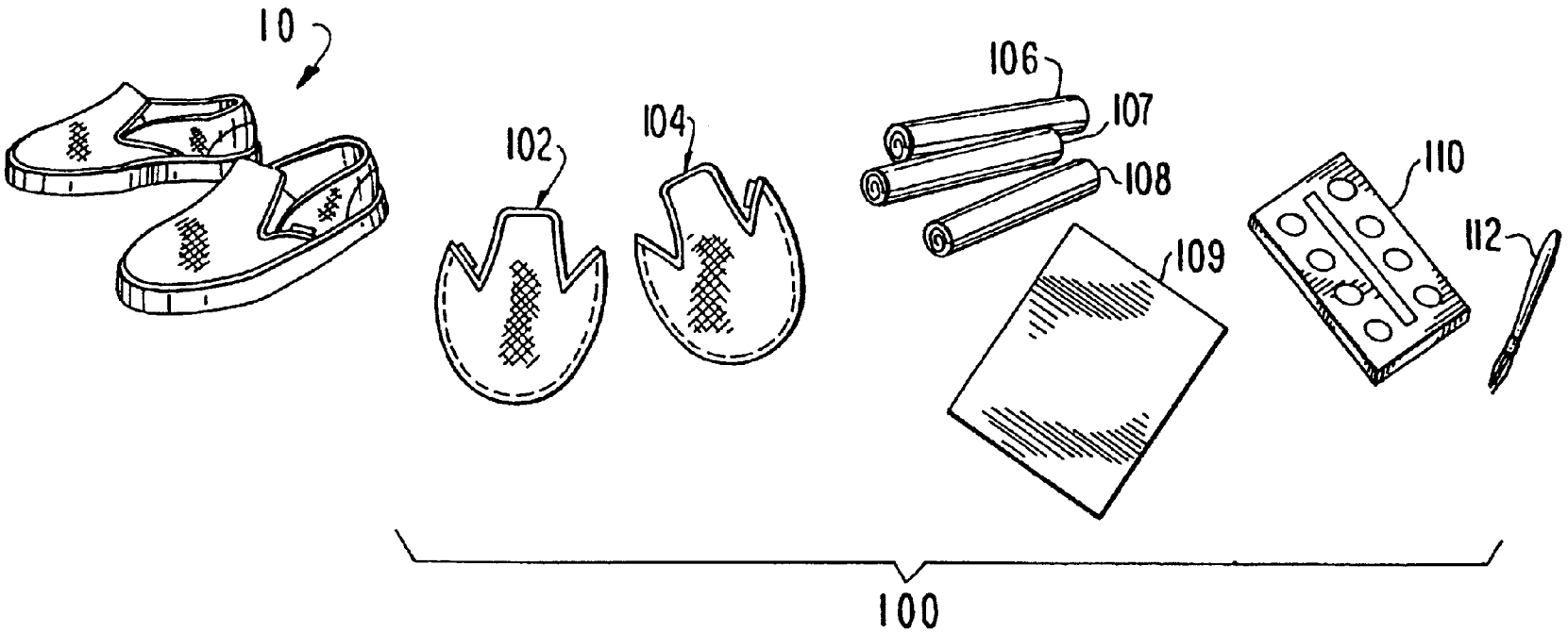
FIG. 5 illustrates a customizing kit that may be provided with the shoes according to the present invention.

FIG. 5 illustrates a customizing kit 100 of a type that may be provided with the shoe construction 10 at time of sale, or may be offered for sale separately. In an implementation, the customizing kit 100 contains a pair of extra vamps 102, 104, four sheets 106, 107, 108, 109 of computer printer heat transfer paper, one set of paints 110 and a brush 112. Written directions may be included with the kit, and/or a website may be available, to explain how to customize the vamp by using digital designs, pictures or photographs. For example, a wearer may decide to use a digital photograph of relatives or a favorite pet to transfer an image onto the vamp 12. A particular digital photograph may be selected using a personal computer or other digital device, such as a digital camera or personal digital assistant. The selected image may then printed onto a sheet of the supplied transfer paper 109 using a conventional color or black-and-white printer. The removable vamp 102 is then flattened out on a flat surface, and the transfer paper is aligned over the vamp so that the image can be transferred from the paper to the vamp by heating. In particular, an iron or other similar device (not shown) having a flat, heatable surface portion may be heated and then applied to the transfer paper to induce a chemical process to occur so that the image on the transfer paper will adhere to the vamp. In this manner, the wearer can print any desired digital design onto the paper and then transfer it to the vamp. In addition, the wearer may use the paints 110 and brush 112 to add designs or other indicia directly to the vamps. In this way a wearer can customize her shoes to include meaningful images or designs of her choice. It is also contemplated that additional customizing kits 100 including heat transfer paper and/or paints and additional blank vamps will be offered so that consumers can create as many interchangeable vamps of various colors and/or designs as desired to customize their shoes.

A number of embodiments of the invention have been described. Nevertheless, it will be understood that various modifications may be made without departing from the spirit and scope of the invention. Accordingly, other embodiments are within the scope of the following claims.

What is claimed is:

1. A method implemented by a wearer for customizing a portion of a shoe that includes a removable vamp comprising:

detaching the removable vamp from the shoe;

flattening the removable vamp;

aligning a sheet of transfer paper containing a design over the vamp;

transferring the design from the transfer paper to the vamp; and reattaching the vamp to the shoe.

2. The method of claim 1 further comprising applying paint to the vamp to create a design.

3. The method of claim 1 wherein the design is created on the transfer paper.

4. The method of claim 3 wherein the design is a digital image.

5. The method of claim 4 further comprising printing the digital image the transfer paper.

6. The method of claim 1 wherein the design is transferred from the paper to the vamp by applying heat.

7. The method of claim 6 wherein the heat is supplied by an iron.

8. The method of claim 1 further comprising supplying additional vamps that can be customized and attached to the shoe.

9. The method of claim 1 further comprising providing a customizing kit that includes at least one pair of removable vamps.

10. The method of claim 1 wherein reattaching the vamp to the shoe comprises attaching a peripheral edge of the vamp to an upper peripheral edge of the shoe, and fastening a throat area of the vamp to an elastic material of the shoe.

* * * * *